United States Patent [19]

Reynolds et al.

[11] 4,251,911

[45] Feb. 24, 1981

[54] METHOD OF TERMINATING COIL WINDINGS

[75] Inventors: Charles E. Reynolds; Donald W. Hughes, both of Mechanicsburg, Pa.

[73] Assignee: AMP Incorporated, Harrisburg, Pa.

[21] Appl. No.: 38,769

[22] Filed: May 14, 1979

Related U.S. Application Data

[62] Division of Ser. No. 874,958, Feb. 3, 1978, Pat. No. 4,166,265.

[51] Int. Cl.[3] ..... H01F 41/10

[52] U.S. Cl. ..... 29/605; 29/418; 29/866

[58] Field of Search ..... 29/605, 596, 602 R, 29/418, 866; 336/192

[56] References Cited

U.S. PATENT DOCUMENTS

| | | | |
|---|---|---|---|
| 4,003,128 | 1/1977 | Dochterman | 29/605 X |
| 4,026,013 | 5/1977 | Hughes | 339/276 R X |
| 4,099,316 | 7/1978 | Morgan et al. | 29/566.2 |
| 4,132,913 | 1/1979 | Lautner et al. | 336/192 X |

OTHER PUBLICATIONS

"Design Considerations for Automatic Termination of Start and Finish Magnet Wire Connections . . . ;" D. S. Lee; Technical Paper; Nov. 1975.

*Primary Examiner*—Carl E. Hall

*Attorney, Agent, or Firm*—Frederick W. Raring

[57] ABSTRACT

A method of terminating coil windings is disclosed in which the ends of the coil wire are wound around posts which are integral with the bobbin prior to and, at the conclusion of, the coil winding process. The bobbin is provided with terminal-receiving cavities located such that the ends of the coil wire extend from the posts across these cavities. Electrical connections to the ends of the coil wire are made by cutting off the posts and thereby severing the wire at a location adjacent to the post and inserting terminals into the cavities which establish contact with the ends of the coil wire. The lead wires can then be connected to the same terminals.

7 Claims, 13 Drawing Figures

METHOD OF TERMINATING COIL WINDINGS

This application is a division of application Ser. No. 874,958 filed Feb. 3, 1978, now U.S. Pat. No. 4,166,265.

FIELD OF THE INVENTION

This invention relates to method for connecting the windings of a coil to lead wires.

BACKGROUND OF THE INVENTION

It is presently common practice to establish electrical contact with the ends of a coil winding by providing metallic terminals in the coil bobbin, winding the ends of the coil around these terminals and then soldering the wire ends to the terminals. The operations of winding the wire ends around the terminals and winding the coil on the bobbin are usually carried out by an automatic coil winding machine.

The present invention is directed to the achievement of a method of establishing electrical connections with the ends of a coil by means of solderless electrical terminals of the general class shown in U.S. Pat. Nos. 4,026,013; 3,979,615 and other solderless terminals being used in the electrical industry. The invention is further directed to the achievement of a terminating method which will be compatible with existing coil winding machinery which is capable of wrapping the ends of the coil wires around terminal posts as described above. It should be mentioned that existing coil winding machines are not compatible with solderless coil winding techniques as presently known and as disclosed in the above identified U.S. patents.

In accordance with a preferred embodiment of the instant invention, the bobbin on which the coil is to be wound is provided with terminal-receiving cavities in the bobbin flange and integral severable posts which extend from the flange at locations adjacent to the cavities. When the coil is wound on the bobbin, the coil winding machine first wraps the coil winding around one of the integral posts and then locates an adjacent portion of the wire with its axis extending across one of the cavities. The windings are then wound on the bobbin and the winding machine then locates an end portion of the wire with its axis extending across the other cavity and winds the end portion on the remaining integral terminal post. Thereafter, terminals are inserted into the cavities and at the same time, the terminal posts are severed from the bobbin. Insertion of the terminals establishes contact with the end of the coil winding wire and the posts are eliminated as scrap.

It is accordingly an object of the invention to provide an improved coil support such as a coil bobbin. A further object is to provide improved methods for the manufacture of electrical coils. A further object is the achievement of solderless electrical coils by manufacturing methods which are compatible with a variety of known types of coil winding equipment.

These and other objects of the invention are achieved in preferred embodiments thereof which are briefly described in the foregoing abstract, which are described in detail below, and which are shown in the accompanying drawing in which.

Figure 1:
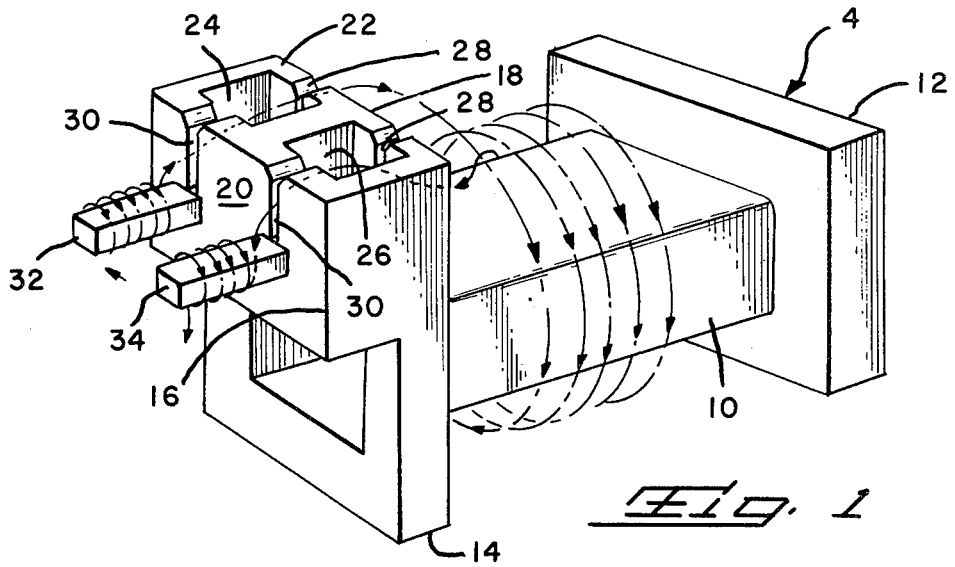
FIG. 1 is a perspective view of one form of coil bobbin in accordance with the invention.
Figure 2:
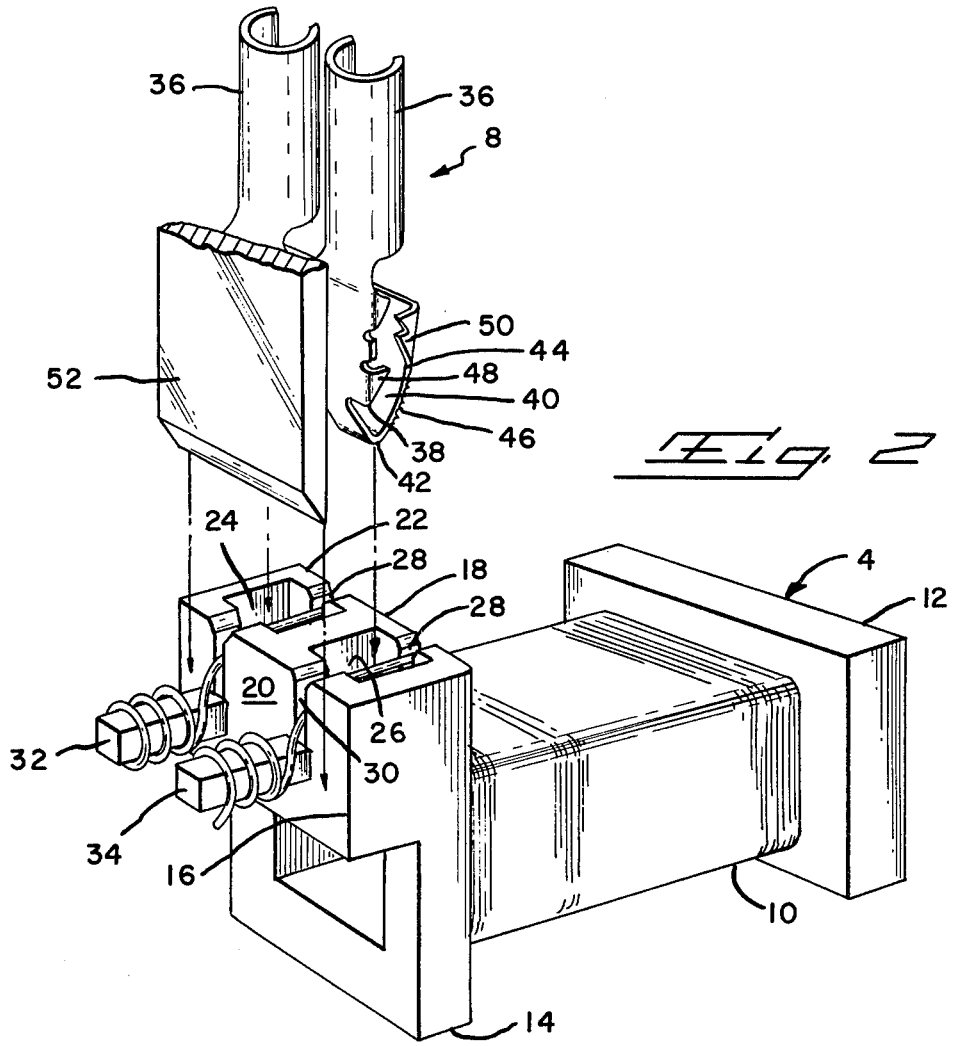
FIG. 2 is a view similar to FIG. 1 but showing the coil wire wound on the bobbin and illustrating the manner of inserting terminals into the cavities of the bobbin and cutting off the wire binding posts.
Figure 3:
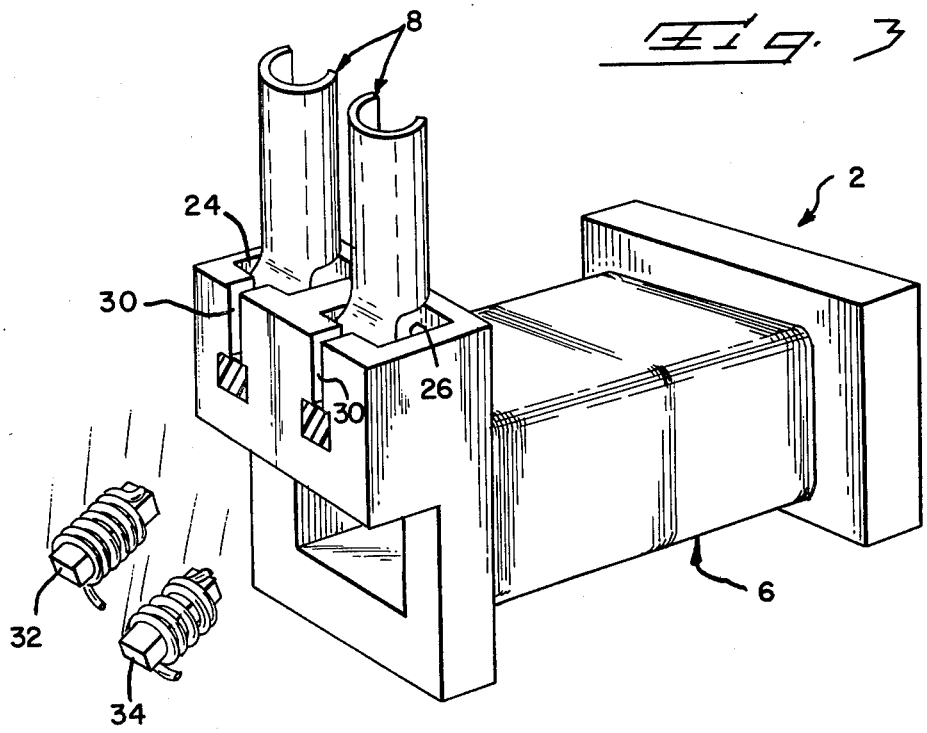
FIG. 3 is a perspective view of the completed coil.

Referring first to the FIGS. 1–3, an electrical coil 2 in accordance with one embodiment of the invention comprises a bobbin 4 having flanges 12, 14 at each end of its coil supporting surface 10. The flange 14 has an enlarged upper portion 16, this enlarged portion having a first surface 18 which is adjacent to coil supporting surface 10 the second surface 20 which is parallel to, and spaced from, surface 18 and a third upwardly facing surface 22 which extends between the first and second surfaces. Two terminal receiving cavities 24, 26 extend inwardly from the surface 22 and slots 28, 30 are provided on the opposed sidewalls of each cavity which are proximate to the surfaces 18, 20 as will be apparent from FIG. 1. These slots are dimensioned to accommodate portions of the coil wire so that the wire can be located in crossing relationship to the cavities. Binding posts 32, 34 extend from the surface 20 adjacent to the lower ends of the slots 30 of each cavity.

Bobbins of the type shown in FIGS. 1–3 are usually manufactured by injection molding of a suitable thermoplastic material such as glass filled nylon material. Advantageously, the material should be such that the binding posts can be severed from the flange 14 during a manufacturing process as will be described below.

In the manufacture of the completed coil assembly 2 the coil wire is first wrapped around the post 32 and then passed through the slot 30, through the cavity 24, and through the slot 28 of the cavity 24. The required number of turns are then wound on the coil supporting surface 10 and after the coil has been wound, the wire is passed through the slot 28 of the cavity 26, across the cavity 26, through the slot 30 and is then wound on the binding post 34.

The electrical connections to the ends of the winding wire are made by inserting terminals 8 (FIG. 2) into each of the terminal receiving cavities 24, 26. Each terminal has an upper receptacle portion 36, which is dimensioned to receive the contact pin on an external conductor, and a conduct portion 38 at its lower end for establishing contact with the coil wire. The contact portion comprises a downwardly extending (as viewed in FIG. 2) web 40 which is reversely bent at 42, to provide upwardly extending contact spring 44. The contact spring has transversely extending serrations 46 on its external surface so that when it is inserted into a cavity, and pressed against one end of a coil wire, these serrations will penetrate the varnish-type insulation of the wire and establish electrical contact. Tangs 48, 50 are provided at the sides of the web portion and on the contact spring for retaining the contact in the cavity. The contact terminal shown may be in accordance with the general principles of the above identified U.S. Pat. No. 4,026,013.

At the time that the contact terminals 8 are inserted into the cavities, a cutting blade 52 is moved downwardly over the surface 20 and the wires are cut adjacent to the fixed ends of the posts 32, 34. Preferably, the posts are also severed from the bobbin flange and drop away as indicated in FIG. 3. It is desirable to cut the ends of the wire immediately prior to engagement of the wire by the contact terminal 8 and to this end, the cutting blade 52 should move in advance of the terminals. The terminals are preferably inserted by an automatic or semi-automatic insertion machine and the cutting blade 52 may be provided on the same machine as taught generally by U.S. Pat. No. 4,099,316. As mentioned previously, it is usually preferable to remove the post 32, 34 as indicated in FIG. 3, but if desired the wires can be simply cut by movement of the blade 52 against the posts so that the posts will remain on the bobbin if they are required for any purpose.

It will be apparent that the method steps described above in the manufacture of the coil 2 can be carried out by manual operations or they can be carried out with varying degrees of automation. For example, the wires might be manually wrapped on the posts and the bobbin rotated by a suitable machine during the winding of the coil. A variety of winding machines are available as previously explained and the operations discussed above can be integrated into the operation of the winding machine.

Figure 4:
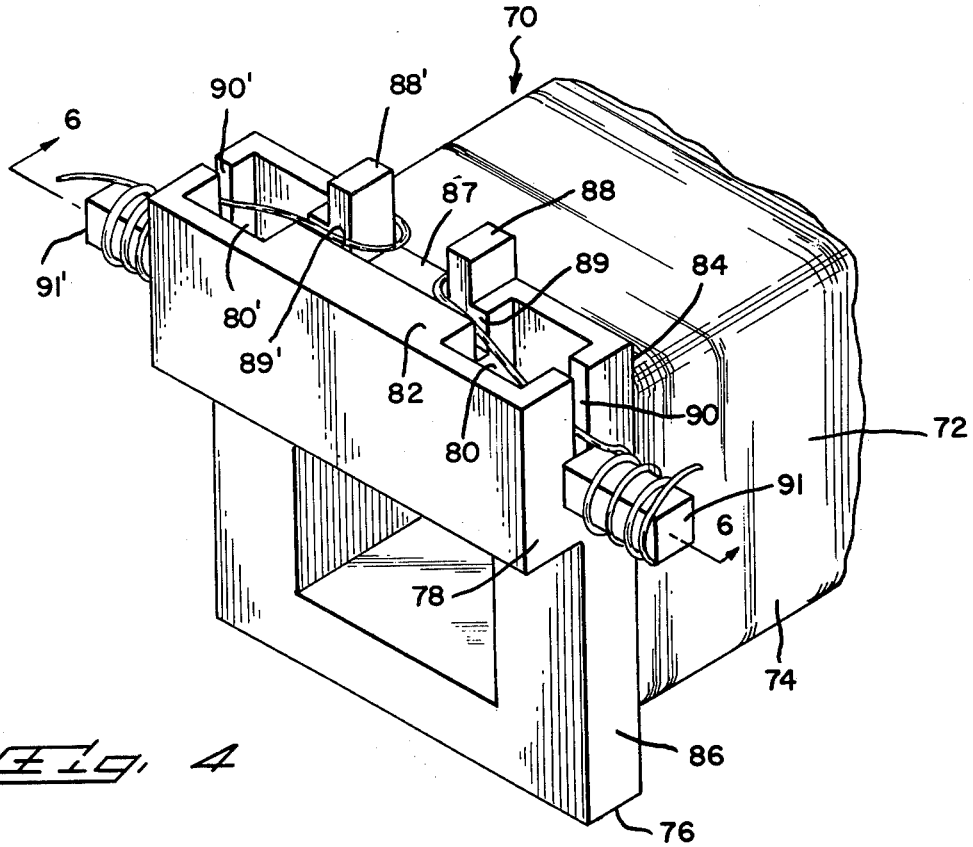
FIG. 4 is a perspective view of an alternative form of bobbin in accordance with the invention having the coil wire wound thereon.
Figure 9:
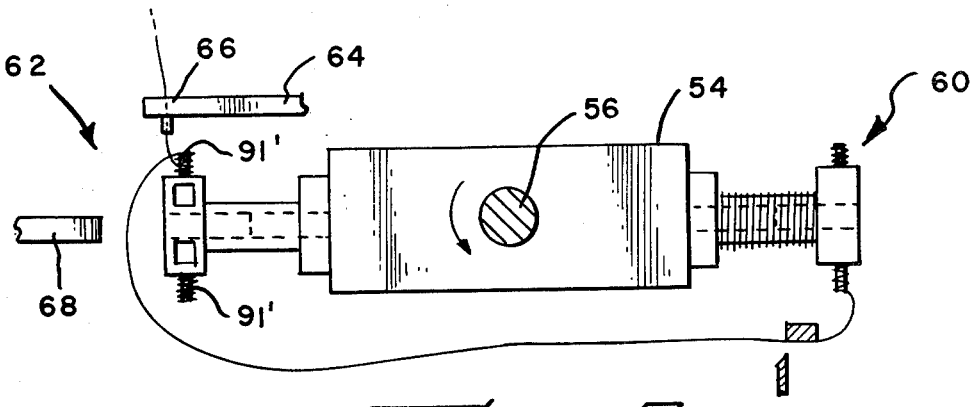
FIG. 9 is a semi-diagrammatic side view showing a portion of a known type of coil winding machine, this view showing the positions of the parts immediately prior to the commencement of a coil winding operation.
Figure 10:
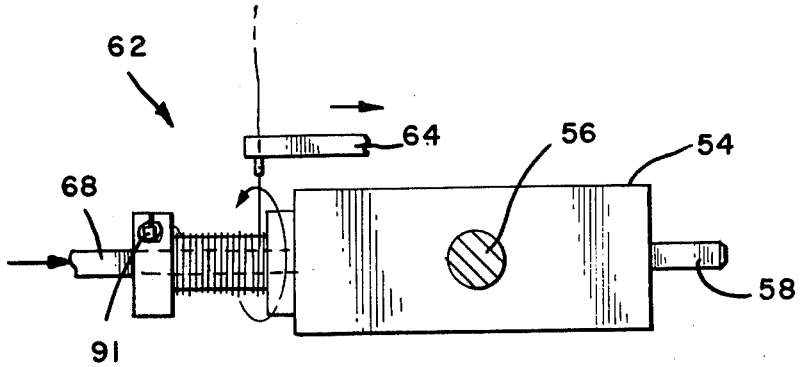
FIGS. 10 and 11 are views similar to FIG. 9 but illustrating the successive steps in the operation of the winding machine.
Figure 11:
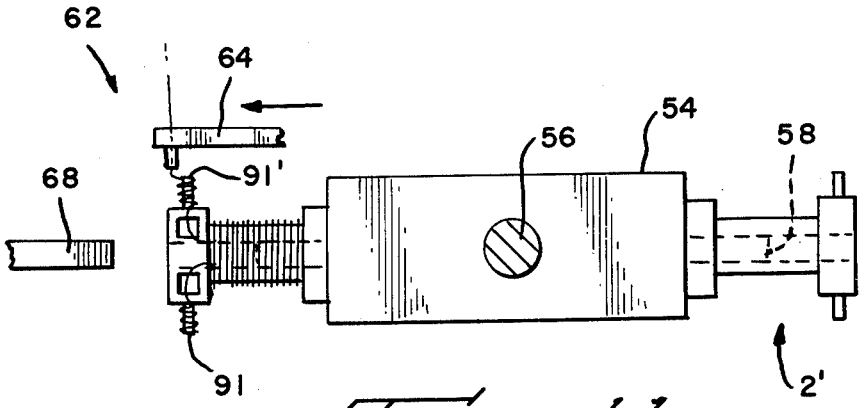

FIG. 4 shows an alternative form of bobbin 70 in accordance with the invention which is particularly intended for use in conjunction with one standard type of bobbin winding machine which is shown in FIGS. 9–11. The bobbin 70 has a coil supporting surface 72 on which the coil 74 is wound and flanges at each end of the surface, one of the flanges being shown at 76. Flange 76 has an enlarged upper portion 78 having an upper terminal-receiving surface 82 into which the cavities 80, 80' extend. The flange also has a surface 84 which is adjacent to the coil and laterally facing side surfaaces 86, 86'.

A centrally located recess 87 is provided in the top surface 82 and integral relatively short guide posts 88, 88' extend upwardly on each side of the recess. The recess 87 communicates with the cavities 80, 80' by way of laterally extending slots 89, 89'. Slots 90, 90' are provided in the side surfaces 86, 86' and wire binding posts 91, 91' extend from these side surfaces adjacent to the inner ends of the slots 90, 90'.

Figure 7:
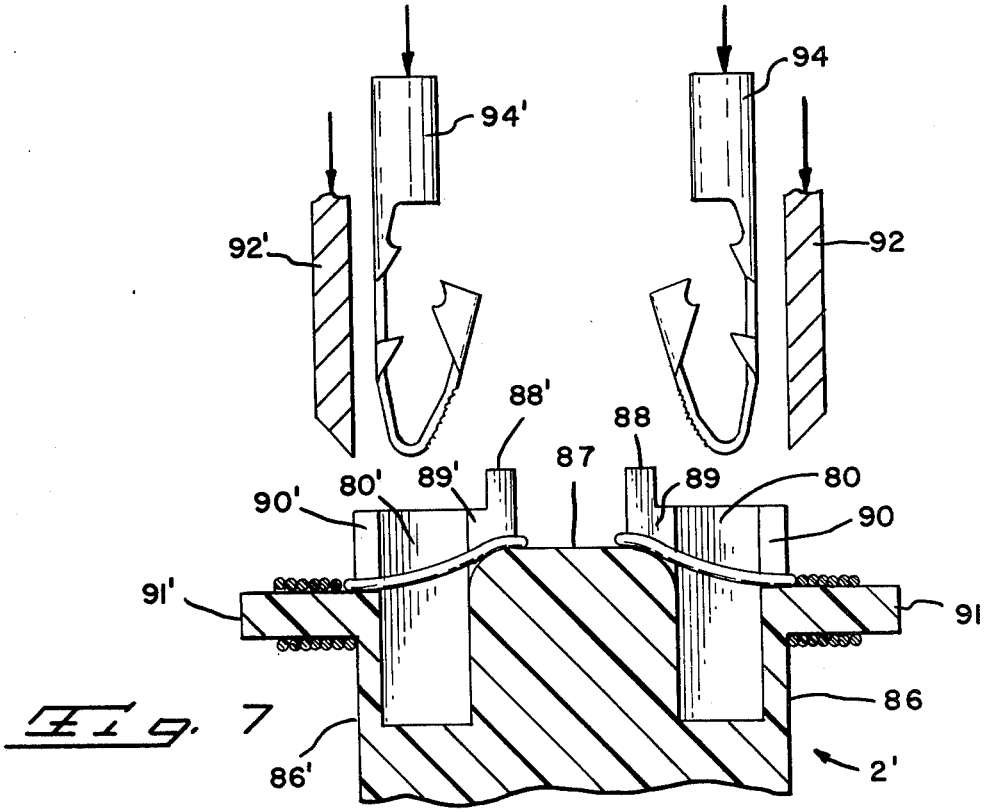
Figure 8:
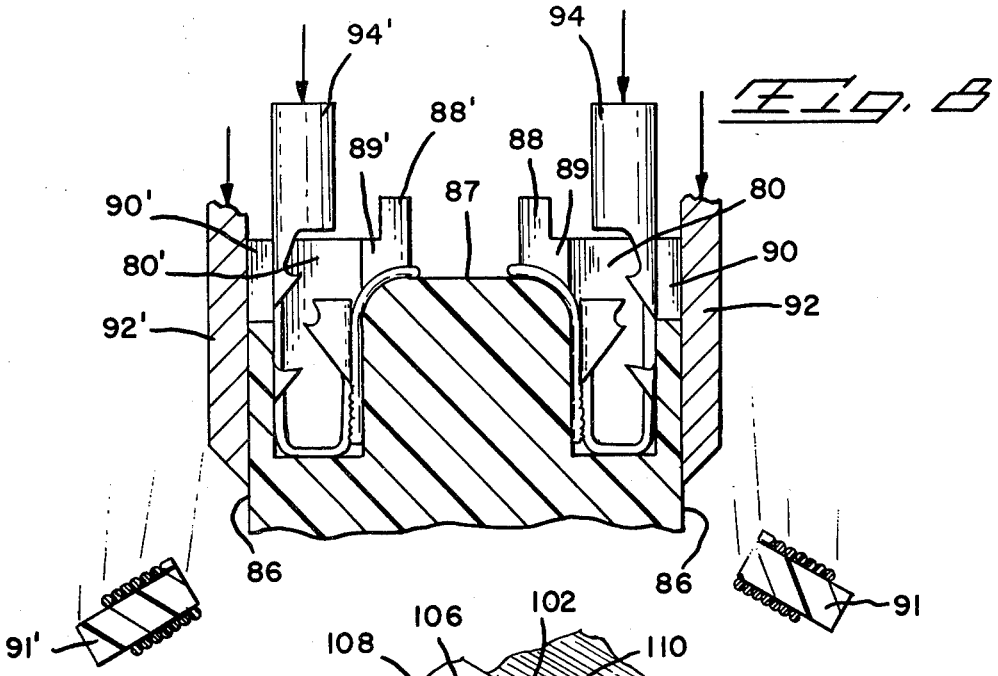

When the coil is wound on the bobbin 70, the wire is first wrapped around the post 91', passed through the slot 90', across the cavity 80', and led around the post 88' as shown. Thereafter, the required number of turns are wound on the coil supporting surface 72. After the turns have been wound on surface 72, the wire is passed across the surface of recess 87, around the guide post 88, through the slot 89, across the cavity 80, through the slot 90, and it is then wound around the post 91. Terminals 94 which may be of the type previously described are then inserted into the cavities as shown in FIG. 7 and cutting blades 92, 92' are moved over the surfaces 86, 86' to cut off the posts and sever the wire. As described previously, the terminals pull the cut ends of the wire into the cavities and establish electrical contact with the wire when the terminal is fully inserted as shown in FIG. 8.

The bobbin shown in FIG. 4 can be used with the type of coil winding machine which is shown diagrammatically in FIGS. 9–11. These figures show one station of a machine which would have a bank of similar stations to permit winding of a plurality of bobbins simultaneously.

The winding machine comprises a central support 54 which can be rotated in the plane of the paper through an angle of 180 degrees with respect to an axis indicated at 56. Coil support arms 58 extend in opposite directions from the support 54 so that one of these arms is always located at the loading station 60 and the other arm will be located at the winding station 62. A wire guide arm 64 is provided at the winding station which has wire guide means 66 at its end for guiding the wire from an endless source, such as a rell, to the bobbin held on the arm 58. Machines of this type under consideration also have a winding mandrel 68 for the bobbin. This winding mandrel is movable from the retracted position of FIG. 9 into the central opening in a bobbin on the arm 58 and is rotatable as shown in FIG. 10 so that the wire can be wound on the bobbin while the arm 64 moves to and fro to distribute the windings evenly over the surface 72.

The arm 64 is also capable of wrapping the wire around the post 91' as shown in FIG. 9 and moving in a manner which will position the wire as shown in FIG. 4 with its axis extending across the cavity 80' and around the post 88' prior to winding of the wire on the bobbin as shown in FIG. 10. It will be understood that these relatively sophisticated winding machines have program control systems for carrying out all of the wrapping, wire positioning and coil winding operations referred to above and described in detail below.

In use, and assuming that the parts are in the position of FIG. 9 with the wire wrapped around the post 91' at the winding station 62, the mandrel 68 first moves into the opening in the bobbin as shown in FIG. 10. Thereafter, the mandrel is caused to rotate through an angle of 90 degrees so that the surface 82 of the bobbin is below the end of the traversing arm 64. The arm 64 then moves along a path which will cause the wire to be laid in the slot 90', in the cavity 80', and around the post 88'. Thereafter, the mandrel rotates at a relatively high speed while the arm 64 traverses to wind the turns on the bobbin. After the required number of turns have been wound on the coil supporting surface, the mandrel is stopped in a position such that the surface 82 is below the arm 64. The arm again positions the wire on the upper surface 84 and in the slot 89 and the mandrel again rotates 90 degrees so that the post 91 is below the arm 64. The arm 64 then wraps the wire around the post 91 as shown in FIG. 11.

The support 54 is then rotated through an angle of 180 degrees to provide an unwound bobbin at the winding station 62 and deliver the wound bobbin to the loading station 60. The operater cuts the wire adjacent to the post 91 of the wound bobbin and removes the bobbin from the arm 58. The terminal inserting operations and cutting operations shown in FIG. 7 can be carried out at a subsequent work station or they can be carried out by mechanisms provided at the loading station 60, if desired.

The general type of winding machine diagrammatically shown in FIGS. 9–11 is produced by Bachi Incorporated of Itasci, Ill., and a typical machine will have many winding stations of the type illustrated in FIGS. 9–11. Machines of this class are extremely sophisticated and provide all of the motions discussed above. Heretofore machines of this class and type have been used to wind coils or bobbins having metallic terminal posts extending therefrom rather than the plastic integral binding posts of the bobbin of FIG. 4. A bobbin of the types shown in FIG. 4 can therefore be substituted for the previously used bobbins having metal terminals extending therefrom, and this substitution can be made without extensive modification of the winding machine. The previously required soldering step can thus be readily replaced by the terminal insertion step and wire trimming step of the present invention.

Figure 12:
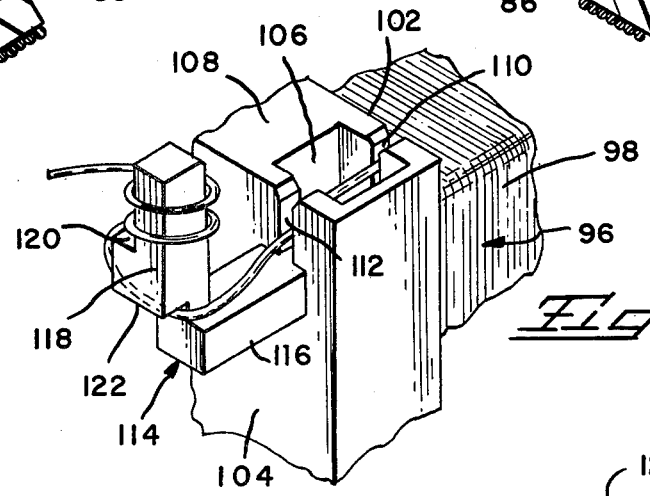
FIG. 12 is a fragmentary view of a portion of a bobbin in accordance with a further embodiment.

FIG. 12 shows a portion of a bobbin 96 in accordance with a further embodiment of the invention. The bobbin 96 has a coil supporting surface 98 and flanges, one of which is shown at 100. The flange 100 has side surfaces 102, 104, the surface 102 being adjacent to the coil supporting surface 98 and the surface 104 facing outwardly from the flange. The terminal receiving cavity 106 extends into the top surface 108 of the flange and wire receiving slots 110, 112, are provided as previously described. The post 114, in this embodiment comprises a first portion arm 116 which extends normally from surface 104 at the inner end of the slot 112 and a vertically extending free arm portion 118 which extends upwardly as viewed in the drawing. An upwardly facing shoulder 120 is provided on the arm 118 and a downwardly facing shoulder 122 is provided on this arm adjacent to the end of the horizontal arm 116.

In use, the wire is wrapped around the vertically extending arm 118 and passed under the shoulder 122. The wire extends from the shoulder 122 along the arm 116, through the cavity 106, and to the wire winding surface or support surface 98. The shoulders 120, 122, serve to stabilize the windings on the post 118 which prevent them from slipping off of the winding post.

It will be understood that at least two cavities 106 and associated winding posts are provided and that after the coil has been wound, the wire is cut and the post 114 is removed as previously described. The embodiment shown in FIG. 12 can be used in conjunction with a coil winding apparatus of the type shown in FIGS. 9–11 since the wire can be wrapped around the vertically extending arm 118 by the traversing arm 64 of the apparatus.

Figure 13:
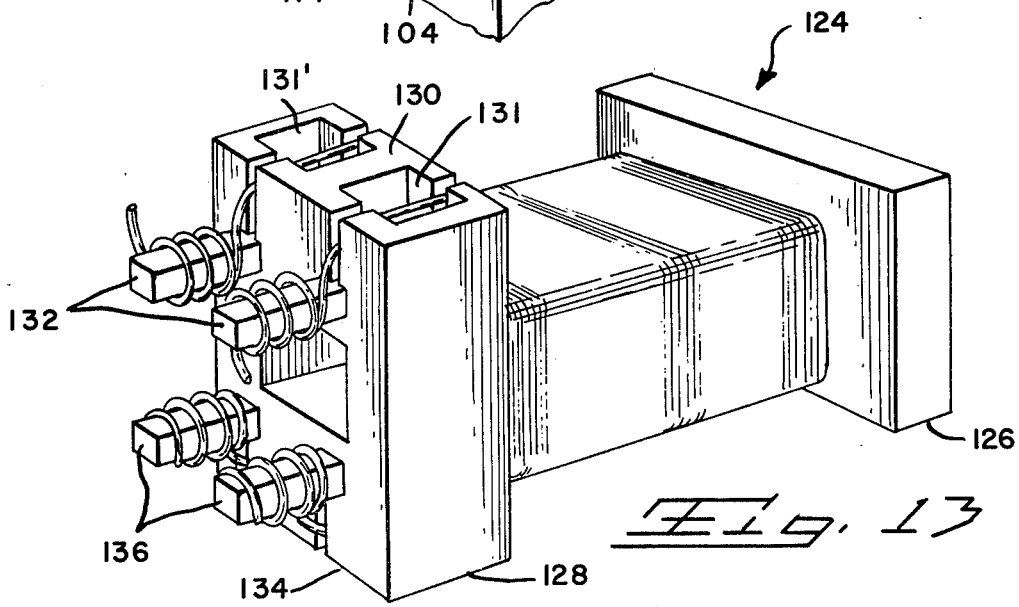
FIG. 13 shows a bobbin of the type shown in FIG. 1, having provision for making tap connections to a coil wound on the bobbin.

The embodiments of the invention described thus far have only two cavities and wire binding posts to permit electrical connection to the ends of the winding wire on the bobbin. Under many circumstances, it is desirable to provide tap connections to the coil at intermediate locations on the winding wire. Tap connections can be provided in accordance with the invention when a bobbin of the general type shown at 124, FIG. 13, is used. This bobbin has flanges 126, 128, at each end of the coil supporting surface and has terminal receiving cavities 131 in the upper surface 130 of the flange 128 and similar cavities extending into the lower surface 134 of the flange. Wire binding posts 132 are provided for the cavities 131 and posts 136 are provided for the cavities extending into the lower surface 134. The principles illustrated by FIG. 13 can be employed to provide tap connections for the other embodiments of the invention discussed above and if desired, terminal receiving cavities can be provided in both of the flanges of the bobbin rather than in only one flange.

It will be apparent that other embodiments of the invention can be devised to satisfy the requirements of a specific coil manufacturing process and/or a specific type of coil winding machine. The principles of the invention can be adopted for a wide range of coil sizes and wire sizes, however, the advantages of the invention are particularly desirable when the wire size is relatively fine, for example AWG 30 and finer. Extremely fine wires are sometimes difficult to control and an accepted method of securing an extremely fine wire is to take several turns around a post as illustrated and described above.

It will be understood that the specific embodiments of the embodiments of the invention disclosed above are representative of a wide variety of embodiments which might be devised for a specific coil support and a specific type of winding machine. The several types of winding machines have different mechanisms for winding the wire on the coil supporting surface and wrapping the wire around metallic terminal posts and specific embodiments of the instant invention can be devised for many of the winding machines which are now used in the electrical industry. The locations of the terminal receiving cavities in the coil supporting member and the locations of the integral posts relative to these cavities can thus be selected in accordance with the requirements of the winding machine being used. Similarly, where the coil is being wound by the winding machine and termination of the coil wire is being carried out with a manually assisted semi-automatic machine, the terminal receiving cavities and the integral posts such as the posts 132, 136 of FIG. 13, can be located on the coil support in positions which will provide maximum convenience and efficiency.

Figure 5:
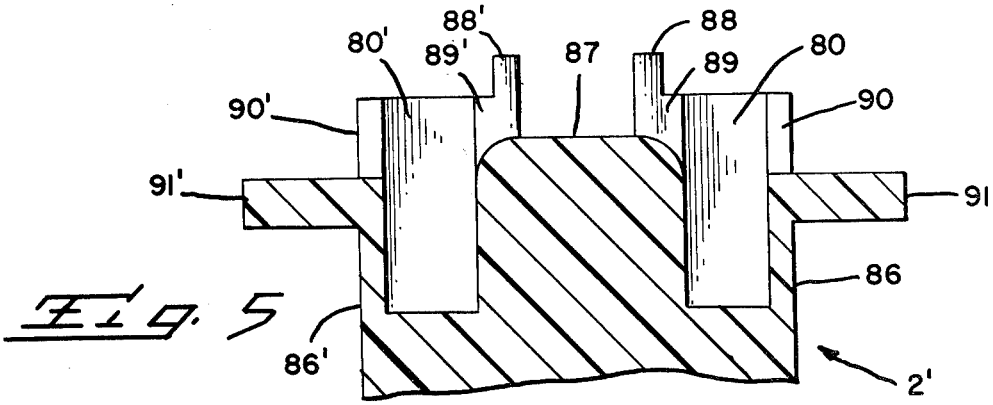
FIGS. 5–8 are sectional views showing the various stages in the manufacture of a coil of the type shown in FIG. 4, these views all being taken along the lines 6—6 of FIG. 4.
Figure 6:
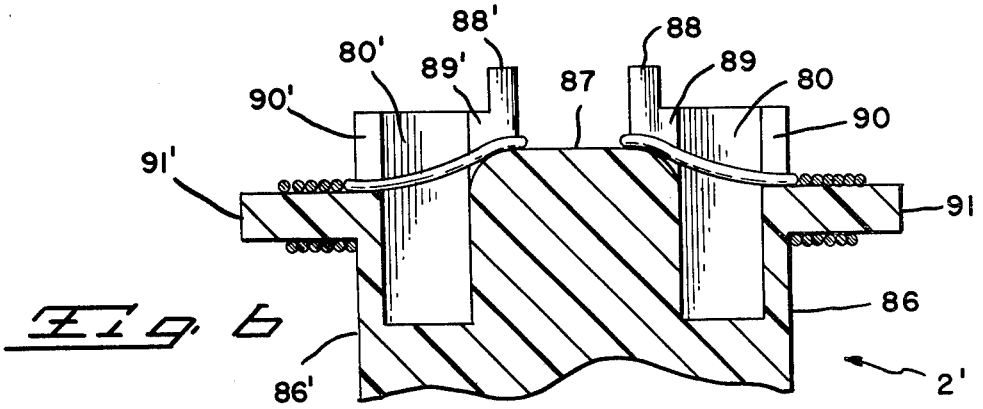

The embodiments of the invention described above all show the type of terminal which is more fully described in the previously identified U.S. Pat. No. 4,026,013 however, the principles of the invention can also be practiced with other types of terminals which are intended to be inserted into a cavity and to establish contact upon insertion with a wire extending across the cavity; for example, with slotted plate-type terminals of the general class disclosed in U.S. Pat. No. 3,979,615. It should be mentioned that the cavities in the coil support will be contoured to receive the specific terminal being inserted and the cavities shown in the accompanying drawing do not have the specific contours and structures required; in other words, the cavities such as the cavities 80, 80', in FIG. 5, are shown diagrammatically in the drawing in the interest of simplicity. Specific details of such cavities are to be found in the above identified U.S. Pat. Nos. 3,979,615 and 4,026,013.

What is claimed is:

1. A method of winding a coil wire on a coil support, such as a coil bobbin of the type which has a coil support surface, coil retaining means extending normally of said coil supporting surface, and at least one terminal post extending from said coil retaining means, said method comprising the steps of:

wrapping the coil wire around said post to secure said wire, passing said coil wire across a terminal receiving cavity in said coil retaining means which is adjacent to said post, winding a number of turns of said coil wire on said coil supporting surface, inserting a terminal of a type having insulation penetrating means into said cavity and thereby connecting said coil wire to said terminal and thereafter moving a cutting blade against said post thereby to cut said wire at said post.

2. A method as set forth in claim 1, including the step of cutting off said post with said cutting blade when said wire is cut.

3. A method of winding a coil wire on a coil support, such as a coil bobbin of the type which has a coil supporting surface, coil retaining means extending normally of said coil supporting surface and at least two terminal posts extending from said coil retaining means, said method comprising the steps of:

wrapping the coil wire around one of said post to secure said wire, passing said coil wire across a first terminal-receiving cavity in said coil retaining means which is adjacent to said one post, winding a number of turns of said coil wire on said coil supporting surface, passing said coil wire across a second terminal receiving cavity in said coil retaining means, wrapping said coil wire around the second one of said posts, inserting terminals of a type having insulation penetrating means into said cavities and thereby connecting said coil wire to said terminals, and thereafter moving cutting blade means against said posts thereby to sever said coil wire adjacent to said posts.

4. A method as set forth in claim 3, including the step of cutting off said posts when said cutting blade means is moved against said posts.

5. A method as set forth in claim 3, including the additional steps of winding an additional number of turns of said coil wire on said coil supporting surface after said coil wire has been wrapped around the second one of said posts, passing said coil wire across a third terminal receiving cavity in said coil retaining means prior to insertion of terminals into said cavities, wrapping said coil wire around a third post, thereafter inserting terminals into all of said cavities, and thereafter moving cutting blade means against all of said posts thereby to sever said coil wire adjacent to all of said posts whereby, terminals are connected to said coil wire at the end thereof and one terminal is connected to said coil wire intermediate the ends thereof to provide a tap connection.

6. A method as set forth in claim 5, including the steps of providing at least two tap connections by repeating said additional steps of claim 5.

7. A method as set forth in claim 6, including the step of cutting off said posts when said cutting blade means is moved against said posts.

* * * * *